United States Patent [19]

Mantarro et al.

[11] Patent Number: 4,572,700

[45] Date of Patent: Feb. 25, 1986

[54] ELONGATED BENDABLE DRAINAGE MAT

[75] Inventors: Joseph Mantarro; Keh-Chang Liu, both of Pensacola, Fla.; Barry J. Dempsey, White Heath, Ill.

[73] Assignee: Monsanto Company, St. Louis, Mo.

[21] Appl. No.: 480,990

[22] Filed: Mar. 31, 1983

[51] Int. Cl.[4] ..... E01C 9/08; E01C 11/10

[52] U.S. Cl. ..... 404/35; 404/66; 428/86; 428/95; 405/45; 52/169.5; 210/486

[58] Field of Search ..... 404/47, 64, 66, 67, 404/69, 35; 52/169.5; 405/45, 50, 24; 428/17, 86, 95; 210/458, 483, 486, 487, 170

[56] References Cited

U.S. PATENT DOCUMENTS

| | | | |
|---|---|---|---|
| 1,746,409 | 2/1930 | Sweetland et al. | 210/486 X |
| 2,023,910 | 12/1935 | Bacheldor | 210/486 |
| 3,263,819 | 8/1966 | Schmidt et al. | 210/486 |
| 3,328,218 | 6/1967 | Noyes | 428/86 X |
| 3,563,038 | 2/1971 | Healy et al. | 61/11 |
| 3,573,142 | 3/1971 | Chidgey et al. | 428/17 |
| 3,654,765 | 4/1972 | Healy et al. | 61/11 |
| 3,765,783 | 10/1973 | Wager | 404/2 |
| 3,782,663 | 1/1974 | Stevenson | 428/17 X |
| 3,830,373 | 8/1974 | Sixt et al. | 210/489 |
| 4,057,500 | 11/1977 | Wager | 210/170 |
| 4,182,581 | 1/1980 | Uehara et al. | 405/43 |
| 4,296,884 | 10/1981 | Luebke | 210/170 X |
| 4,311,273 | 1/1982 | Marsh | 14/73 X |
| 4,389,434 | 6/1983 | Polman | 428/17 |
| 4,389,435 | 6/1983 | Haas, Jr. | 428/17 |
| 4,391,870 | 7/1983 | Ellis | 428/17 X |
| 4,405,665 | 9/1983 | Beaussier et al. | 428/95 X |

FOREIGN PATENT DOCUMENTS

| | | | |
|---|---|---|---|
| 893615 | 10/1982 | Belgium . | |
| 023871 | 11/1981 | European Pat. Off. . | |
| 0064140 | 11/1982 | European Pat. Off. | 428/17 |
| 1384810 | 11/1964 | France | 210/486 |
| 2422772 | 12/1979 | France | 405/50 |
| 2102041 | 1/1983 | United Kingdom . | |
| 2056236 | 3/1983 | United Kingdom . | |

OTHER PUBLICATIONS

Civil Engineering, Suppl. Mar. 1981, London, "The Trammel Drainage System", pp. 24–26, (p. 25).

Civil Engineering—A SCE, vol. 46, No. 3, Mar. 1976, "Plastic Filter Fabrics . . . ", pp. 57–59, (p. 58).

Dempsey, B. J., "Climatic Effects on Airport Pavement Systems State of the Art", Report No. FAA-RD-7-5-196 (NTIS No. AD/A-029, 422), Jun. 1976.

Copeland, J. A., "Fabrics in Subdrains: Mechanisms of Filtration and the Measurement of Permeability", Transportation Research Report 80-2, Jan. 1980, pp. 97–104.

Mitsui Petrochemical Industries—Product Bulletin: "CULDRAIN".

Nylex Product Bulletins: "STRIPDRAIN" and COR-DRAIN.

American Enka Company—Product Bulletin: "ENKA-DRAIN".

*Primary Examiner*—Stephen J. Novosad
*Assistant Examiner*—John F. Letchford
*Attorney, Agent, or Firm*—Thomas E. Kelley; Arthur E. Hoffman

[57] ABSTRACT

Elongated, bendable drainage mat having a rectangular transverse cross section and comprising a polymeric core having a plurality of substantially rigid fingers extending from one side of a layer and an enveloping water permeable fabric having a permittivity from 0.2 seconds$^{-1}$ to 2.0 seconds$^{-1}$ and a dynamic permeability after $10^6$ loadings of at least $10^{-4}$ centimeters per second.

Apparatus and systems using such drainage mat.

13 Claims, 16 Drawing Figures

ELONGATED BENDABLE DRAINAGE MAT

BACKGROUND OF THE INVENTION

This invention relates to multidirectional drainage mats which are useful and effective, for instance as a highway edge drain for the dewatering of highway pavement systems.

The problem of water in pavements has been of concern to engineers for a considerable period of time. As early as 1823 McAdam reported to the London (England) Board of Agriculture on the importance of keeping the pavement subgrade dry in order to carry heavy loads without distress. He discussed the importance of maintaining an impermeable surface over the subgrade in order to keep water out of the subgrade.

The types of pavement distresses caused by water are quite numerous. Smith et. al. in the "Highway Pavement Distress Identification Manual" (1979) prepared for the Federal Highway Administration of the United States Department of Transportation identifies most of the common types of distresses.

Moisture in pavement systems can come from several sources. Moisture may permeate the sides, particularly where coarse-grained layers are present or where surface drainage facilities within the vicinity are inadequate. The water table may rise; this can be expected in the winter and spring seasons. Surface water may enter joints and cracks in the pavement, penetrate at the edges of the surfacing, or percolate through the surfacing and shoulders. Water may move vertically in capillaries or interconnected water films. Moisture may move in vapor form, depending upon adequate temperature gradients and air void space. Moreover, the problem of water in pavement systems often becomes more severe in areas where frost action or freeze-thaw cycles occur, as well as in areas of swelling soils and shales.

The types of pavement distresses caused by water are quite numerous and vary depending on the type of pavement system. For flexible pavement systems some of the distresses related to water either alone or in combination with temperature include: potholes, loss of aggregates, raveling, weathering, alligator cracking, reflective cracking, shrinkage cracking, shoving, and heaves (from frost or swelling soils). For rigid pavement systems, some of the distresses include faulting, joint failure, pumping, corner cracking, diagonal cracking, transverse cracking, longitudinal cracking, shrinkage cracking, blowup or buckling, curling, D-cracking, surface spalling, and steel corrosion, and heaving (from frost or swelling soils).

Similar types of distresses occur in taxiways and runways of airfields.

Numerous of these joint and slab distresses are related to water pumping and erosion of pavement base materials used in rigid pavement construction. Water pumping and erosion of pavement base materials have been observed to cause detrimental effects on shoulder performance as well. Also, many of the distresses observed in asphalt concrete pavements are caused or accelerated by water.

For instance, faulting at the joints is a normal manifestation of distress of unreinforced concrete pavements without load transfer. Faulting can occur under the following conditions:

1. The pavement slab must have a slight curl with the individual slab ends raised slightly off the underlying stabilized layer (thermal gradients and differential drying within the slab create this condition).

2. Free water must be present.

3. Heavy loads must cross the transverse joints first depressing the approach side of the joint, then allowing a sudden rebound, while instantaneously impacting the leave side of the joint causing a violent pumping action of free water.

4. Pumpable fines must be present (untreated base material, the surface of the stabilized base or subgrade, and foreign material entering the joints can be classified as pumpable fines).

Faulting of ¼ in. or more adversely affects the riding quality of the pavement system.

Methods for predicting and controlling water contents in pavement systems are well documented by Dempsey in "Climatic Effects on Airport Pavement Systems—State of the Art", Report No. FAA-RD-75-196 (1976), United States Department of Defense and United States Department of Transportation. Methods for controlling moisture in pavement systems can generally be classified in terms of protection through the use of waterproofing membranes and anticapillary courses, the utilization of materials which are insensitive to moisture changes, and water evacuation by means of subdrainage.

Field investigations indicate that evacuation by means of a subdrainage system is often the preferred method for controlling water in pavement systems. In this regard proper selection, design, and construction of the subdrainage system is important to the long-term performance of a pavement. A highway subsurface drainage system should, among other functions, intercept or cut off the seepage above an impervious boundary, draw down or lower the water table, and/or collect the flow from other drainage systems.

Existing highway drains include a multitude of designs. Among the simplest are those which comprise a perforated pipe installed at the bottom of an excavated trench backfilled with sand or coarse aggregate. For instance, a standard drain specified by the State of Illinois requires a 4-inch diameter perforated pipe be placed in the bottom of a trench 8 inches (20.3 cm) wide by 30 inches (76 cm) deep. The trench is then backfilled with coarse sand meeting the State of Illinois standard FA1 or FA2. Such drains are costly to fabricate in terms of labor and materials. For instance the material excavated from the trench must be hauled to a disposal site, and sand backfill must be purchased and hauled to the drain construction site.

Other types of drains have attempted to avoid the use of the perforated pipe by utilizing a synthetic textile fabric as a trench liner. The fabric-lined trench is filled with a coarse aggregate which provides a support for the fabric. The void space within the combined aggregate serves as a conduit for collected water which permeates the fabric. Such drains are costly to install, for instance in terms of labor to lay in and fold the fabric as well as in terms of haulage of excavated and backfill material. Moreover, there is considerable fabric area blocked by contact with the aggregate surface. This results in an increased hydraulic resistance through the fabric areas contacting the aggregate surface.

Other modifications to drainage material include fabric covered perforated conduit, such as corrugated pipe as disclosed by Sixt et. al. in U.S. Pat. No. 3,830,373 or raised surface pipe as disclosed by Uehara et. al. in U.S. Pat. No. 4,182,591. A disadvantage is that the planar surface area available for intercepting subsurface water is limited to approximately the pipe diameter unless the fabric covered perforated conduit is installed at the bottom of an interceptor trench filled, say, with coarse sand. A further disadvantage is that much of the fabric surface, say about 50 percent, is in contact with the conduit, thereby reducing the effective collection area.

The problem of limited planar surface area for intercepting subsurface water is addressed by drainage products disclosed by Healy et. al. in U.S. Pat. Nos. 3,563,038 and 3,654,765. Healy et. al. generally disclose a planar extended surface core covered with a filter fabric which serves as a water collector. One edge of the core terminates in a pipe-like conduit for transporting collected water. Among the configurations for the planar extended core are a square-corrugated sheet and an expanded metal sheet. A major disadvantage of designs proposed by Healy et. al. is that the drains are rigid and not bendable; this requires excavation of sufficiently long trenches that an entire length of drain can be installed. The pipe-like conduit requires a wider trench than might otherwise be needed. Moreover, the expanded metal sheet core does not provide adequate support to the fabric which can readily collapse against the opposing fabric surface, thereby greatly reducing the flow capacity within the core. Also the square corrugated sheet core is limited in that at least 50 percent of the fabric surface arc is occluded by the core, thereby reducing water collection area.

A related drainage material with extended surface is a two-layer composite of polyester non-woven filter fabric heat bonded to an expanded nylon non-woven matting, such as ENKADRAIN TM foundation drainage material available from American Enka Company of Enka, N.C. The drainage material which can be rolled has filter fabric on one side of the nylon non-woven matting. The drainage material serves as a collector only and requires installation of a conduit at the lower edge. This necessitates costly excavation of wide trenches, in addition to cost of conduit.

Another related drainage material with extended surface comprises a filter fabric covered core of cuspated polymeric sheet, such as STRIPDRAIN drainage product available from Nylex Corporation Limited of Victoria, Australia. The impervious cuspated polymeric sheet divides the core into two isolated opposing sections which keeps water collected on one side on that side. Moreover, in order that the drainage material be flexible, the core must be contained in a loose fabric envelope which, being unsupported on the core, can due to soil loading collapse into the core thereby blocking flow channels. The cuspated polymeric sheet is bendable only along two perpendicular axes in the plane of the sheet. This makes installation somewhat difficult, for instance whole lengths must be inserted at once in an excavated trench.

A still further similar polymeric drainage product comprises a perforated sheet attached to flat surfaces of truncated cones extending from an impervious sheet, such as CULDRAIN board-shaped draining material available from Mitsui Petrochemical Industries, Ltd. The perforated sheet has holes in the range of 0.5 to 2.0 millimeters in diameter and allows fine and small particles to be leached from the subsurface soil.

The drainage materials available have one or more significant disadvantages, including economic disadvantages of requiring extensive amounts of labor for installation and performance disadvantages such as requiring separate conduit for removing collected water. A further performance disadvantage is that the drainage materials utilize fabric which, depending on the adjoining soil, may become blinded with soil particles or may allow too much material to pass through resulting in loss of subgrade support.

This invention overcomes most if not all of the major disadvantages of such drainage materials. For instance the drainage mat of this invention serves both as a collector, as well as a conduit for removing, intercepted ground water. The drainage mat of this invention is flexible along any axis into one plane of its major longitudinal surface, this greatly facilitates installation of long lengths of drainage mat in incremental lengths as trenches are excavated and backfilled within a short length. This provides a significant economic advantage in installation cost when automatic installation equipment is utilized. One embodiment of the drainage mat of this invention can, depending on hydraulic gradient, allow intercepted water to flow through any surface of the mat into a common conduit.

In the description of the present invention, the following definitions are used.

The term "elongated drainage mat" as used in this application refers to a drainage mat having a length substantially larger than its width or depth.

The term "axis of elongation" as used in this application refers to the axis passing through the center of an elongated drainage mat along its length.

The term "transverse rectangular cross section" as used in this application refers to a cross section of an elongated drainage mat in a plane normal to the axis of elongation of the drainage mat.

The term "pointing" as used in this application means a direction in which the axis of elongation of an elongated drainage mat is extended or aimed.

An elongated drainage mat is said to be "vertically-pointed" when the axis of elongation of the drainage mat is generally vertical with respect to the surface of the earth.

An elongated drainage mat is said to be "horizontally-pointed" when the axis of elongation of the drainage mat is generally horizontal with respect to the surface of the earth.

The term "orientation" as used in this application refers to the attitude of an elongated drain mat having a rectangular transverse cross section determined by the relationship of the axes of the rectangular transverse cross section.

An elongated horizontally-pointed drainage mat having a rectangular transverse cross section is said to be "vertically-oriented" when the axis of the rectangular transverse cross section having the larger dimension is in a vertical position and the axis of the rectangular transverse cross section having the smaller dimension is in a horizontal position. The same drainage mat, when rotated 90° around its axis of elongation, is said to be "horizontally-oriented".

Among the useful parameters for characterizing fabric useful in the drainage mat of this invention is the coefficient of permeability which indicates the rate of water flow through a fabric material under a differential pressure between the two fabric surfaces expressed in terms of velocity, e.g., centimeters per second. Such coefficients of permeability can be determined in accordance with American Society for Testing and Materials (ASTM) Standard D-737. Because of difficulties in determining the thickness of a fabric for use in determining a coefficient of permeability, it is often more convenient and meaningful to characterize fabric in terms of permittivity which is a ratio of the coefficient of permeability to fabric thickness, expressed in terms of velocity per thickness, which reduces to inverse time, e.g., seconds$^{-1}$. Permittivity can be determined in accordance with a procedure defined in Appendix A of Transportation Research Report 80-2, available from the United States Department of Transportation, Federal Highway Administration.

Engineering fabrics used with drainage mats can be quite effective in protecting soil from erosion while permitting water to pass through the fabric to the conduit part of the drainage mat. However, the fabric must not clog or in any way significantly decrease the rate of flow. At the same time the fabric must not let too much material pass through, or clogging of the drainage mat could occur. However, loss of subgrade soil support could also occur.

When considering the actual soil-filter fabric interaction, a rather complex bridging or arching occurs in the soil next to the fabric that permits particles much smaller than the openings in the fabric to be retained. Failure of the soil-fabric system can result from either excessive piping of soil particles through the fabric or from substantial decrease in permeability through the fabric and adjacent soil.

The use of engineering fabrics in highway drainage mats requires the consideration of an additional factor. A highway is subjected to repeated dynamic loading by traffic. Such loading can lead to substantial pore pressure pulses in a saturated pavement system. During and after heavy rain a soil-filter fabric at the pavement edge may be subjected not only to a static hydraulic gradient, but also to a dynamic gradient caused by the highway traffic loading.

In this regard another useful parameter for characterizing fabric useful in the drainage mat of this invention is "dynamic permeability" which indicates the rate of water flow through a column of specifically gradated soil over a layer of fabric material under a combined static and dynamic hydraulic gradient. "Dynamic permeability" characterizes fabric performance in resisting blinding and pluggage under conditions which duplicate the effects of repeated traffic loading. The method for determining "dynamic permeability" is disclosed in Example III, herein.

SUMMARY OF THE INVENTION

This invention provides an elongated, bendable drainage mat having a rectangular cross section. The drainage mat comprises a polymeric core having a plurality of fingers extending from one side of a layer and an enveloping water permeable fabric. The fabric has a permittivity from 0.2 seconds$^{-1}$ to 2.0 seconds$^{-1}$ and a dynamic permeability after $10^6$ loadings of at least $10^{-4}$ centimeters per second.

So that the fabric does not unduly collapse in a flow-restricting manner into the conduit area of the mat it is generally desired that the fabric be secured to a sufficient number of the ends of the fingers. In most constructions the mat is bendable only such that the surface proximate the layer becomes convex.

This invention also provides a number of improved systems utilizing such drainage mat including, for instance, an improved highway system.

DESCRIPTION OF THE PREFERRED EMBODIMENTS

The elongated, bendable polymeric drainage mat having a rectangular transverse cross section comprises a polymeric core having a plurality of substantially rigid fingers extending from one side of a layer and an enveloping water permeable fabric. The fabric has a permittivity from 0.2 seconds$^{-1}$ to 2.0 seconds$^{-1}$ and a dynamic permeability after $10^6$ loadings of at least $10^{-4}$ centimeters per second. It is generally desirable that the fabric be secured to the core to avoid undesirable movement of the fabric relative to the core. For instance the fabric can be secured to the layer. In those instances when the layer is perforated, or otherwise permeable, the fabric should totally envelop the core including the perforated layer such that perforations in the layer are covered by fabric. To avoid occluding flow channels within the core the fabric should also be secured to a sufficient number of ends of said fingers such that the fabric does not unduly collapse into space around the fingers. In some instances it may be sufficient that the fabric be secured to relatively few of the plurality of fingers, for instance less than 50 percent, say even as low as 30 percent or even 10 percent, of the fingers to avoid movement of the fabric relative to the ends of the fingers such that the fabric would unduly collapse into the space around the fingers thereby occluding cross-sectional area otherwise available for fluid flow. In other cases it may be desirable that the fabric be secured to substantially all of the fingers to ensure that the structure of the drainage mat is maintained with a maximum transverse cross-sectional area even after severe handling, for instance in installation.

The drainage mats of this invention have unique properties characterized by a large surface area available for drainage, bendability for ease of installation, and a large open transverse cross-sectional area which serves as a conduit for allowing high multi-directional flow volumes for rapid evacuation of collected water.

Figure 1:
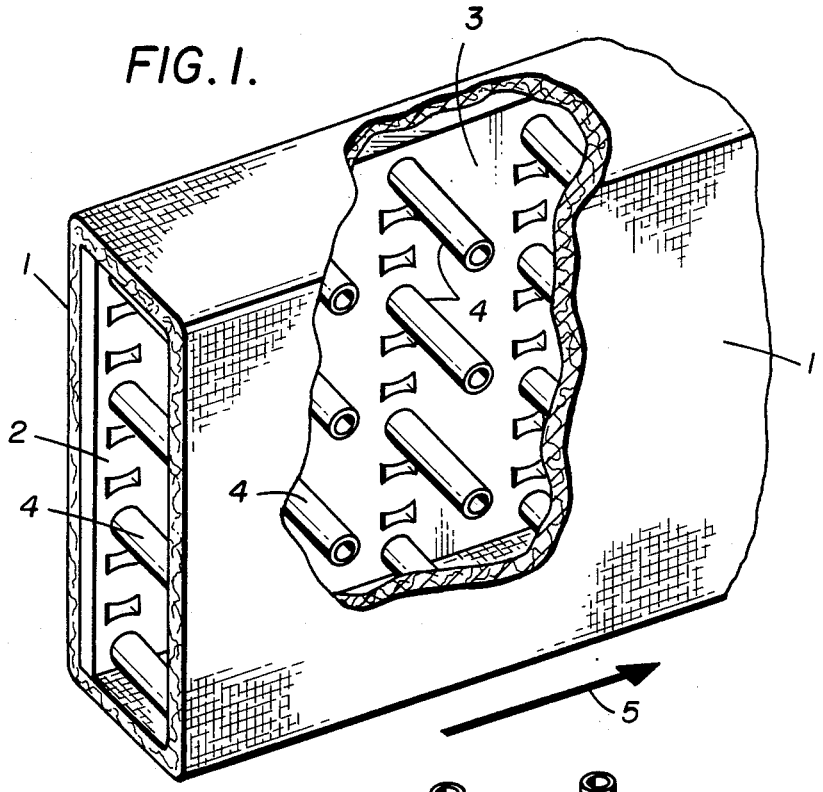
FIG. 1 illustrates an embodiment of a drainage mat according to this invention.
Figure 2:
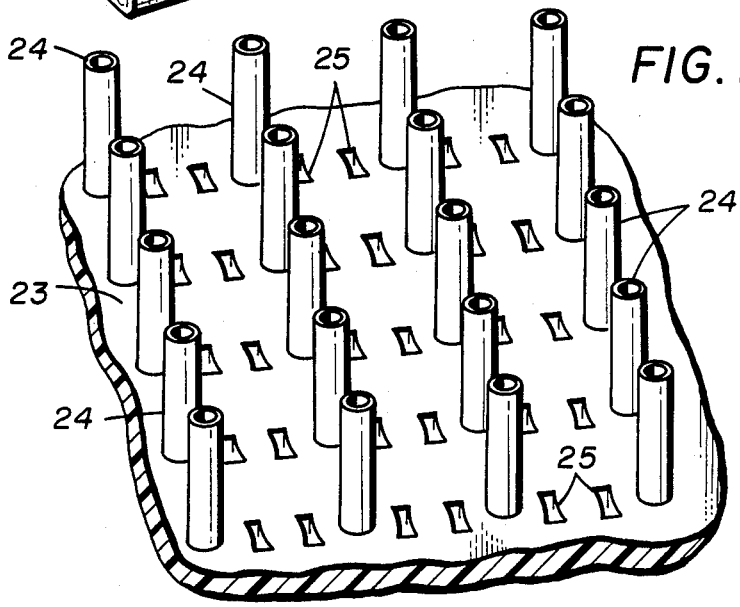
FIG. 2 illustrates an embodiment of a perforated layer having rod-like projections useful as the three-dimensional core in a drainage mat according to this invention.
Figure 3:
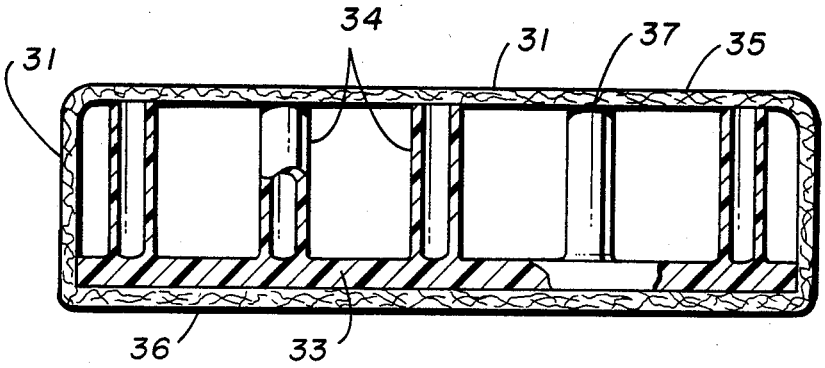
FIG. 3 illustrates a transverse cross-sectional view of a drainage mat.

A preferred form of the drainage mat of this invention is illustrated in FIGS. 1, 2 and 3. In general, FIG. 1 schematically illustrates an embodiment of a section of drainage mat of this invention where water permeable fabric 1 envelops core 2 having a plurality of substantially rigid fingers 4 extending from one side of a layer 3. The axis of elongation of the mat is indicated by axis 5.

FIG. 2 schematically illustrates an embodiment of a section of polymeric core useful in the drainage mat where the core has a plurality of fingers 24 extending from layer 23.

FIG. 3 schematically illustrates a transverse cross section of drainage mat where fabric 31 envelops a core having a plurality of substantially rigid fingers 34 extending from one side of a layer 33.

Figure 5:
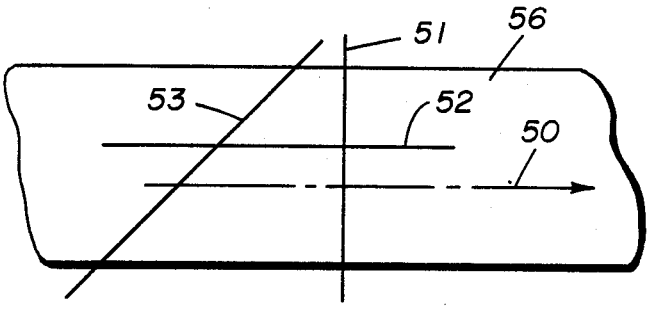
FIG. 5 schematically illustrates the position of bending axes with reference to the axis of elongation superimposed on the drainage mat surface which is proximate the ends of the fingers.

With reference to FIG. 3, the drainage mat of this invention is readily bendable into the surface 35 proximate the ends 37 of the fingers 34. That is, the drainage mat is readily bendable only such that the surface 35 proximate the ends 37 of the fingers 34 become concave, and the surface 36 proximate the layer 33 becomes convex. In this regard the drainage mat can not be folded upon itself into the surface 36 proximate the layer 33 without an undue amount of force which is likely to tear the fabric or deform or collapse the core. This is especially the case when the fabric is bonded to the core. The mat is however readily bendable with little force such that the surface 35 proximate the ends 37 of the fingers 34 will readily and easily bend upon itself even up to about 180° around a bending axis having a radius of less than about 1 inch (2.54 cm), for instance as low as 0.25 inches (0.63 cm). This bending into the surface proximate the ends of the fingers can be achieved around any bending axis parallel to the surface 35. In this regard FIG. 5 illustrates various bending axes superimposed on a drainage mat surface 56 proximate the ends of the fingers. Such bending axes are parallel to the surface 56 and are defined by their rotational disposition from axis of elongation 50 of the drainage mat. A bending axis can be rotationally disposed at any angle from 0° to 180° from the axis of elongation 50. For instance the bending axis 51 is normal to the axis of elongation 50 (that is, the bending axis 51 is rotationally disposed at an angle of 90° from the axis of elongation 50). The drainage mat can be folded upon itself around bending axis 51 resulting in a shorter length; or such mat can be rolled into a short cylindrical spiral roll. The bending axis 52 is parallel to the axis of elongation 50 (that is, the bending axis 52 is rotationally disposed at an angle of 0° from the axis of elongation 50). The drainage mat can be folded around bending axis 52 upon itself lengthwise or rolled into a long spiral roll.

Figure 6:
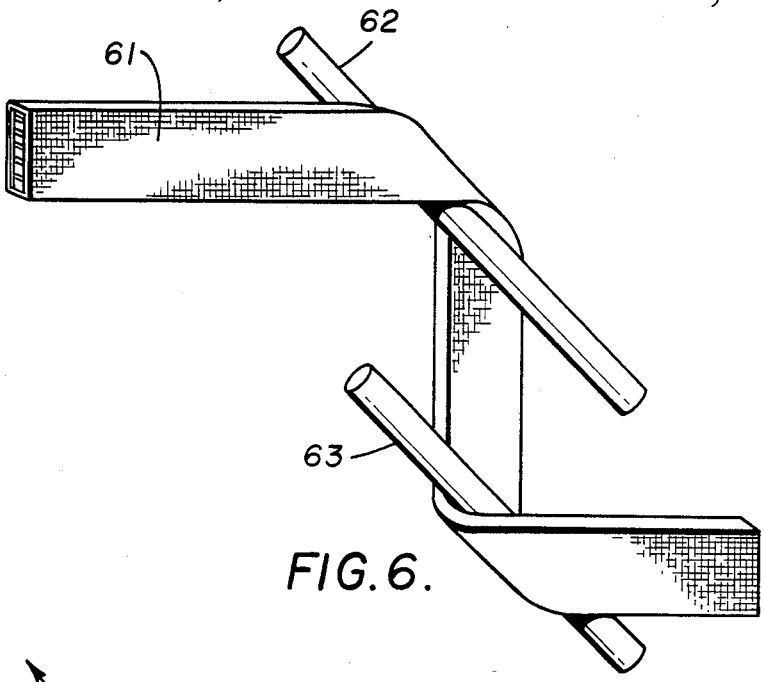
FIG. 6 schematically illustrates the characteristic of a drainage mat to change horizontal/vertical-pointing by rotating around a bending axis disposed at an angle of 45° from the axis of elongation.

When the drainage mat is folded upon itself up to about 180° on a bending axis 53 which is rotationally disposed at an angle of 45° from the axis of elongation 50, the axis of elongation 50 of the drainage mat will effect a 90° bend, as illustrated in FIG. 6. This property of the drainage mat is particularly useful for those installations where the drainage mat 61 is to be installed below grade in a vertical orientation. In this regard the drainage mat can be provided in a vertical orientation above grade and guided to a roller 62 at an angle of 45°. The drainage mat directed around such a roller 62 will be normal to a horizontal plane and can be guided to a second roller 63 at an angle of 45° at an elevation below grade. This second roller 63 will direct the drainage mat into a vertical orientation below grade in a position for its utilization.

Of course, rollers at other angles can be utilized to effect such changes in elevation. Moreover, changes in horizontal position can also be effected by rollers disposed in horizontally parallel planes.

The drainage mat of this invention provides a large open transverse cross-sectional area which provides little resistance to flow in any direction. A large open transverse cross-sectional area is provided by selecting an optimum number of substantially rigid fingers which provide the spaced-apart fabric surfaces.

The core for use in the drainage mat of this invention is three-dimensional, having a plurality of substantially rigid fingers extending from one side of a layer. The layer can be impervious or perforated, depending on the intended use. When it is desirable that the drainage mat be capable of intercepting water from both major surfaces the layer should be perforated. A core with a perforated layer is illustrated in FIG. 2 where layer 23 has a plurality of perforations 25. Such perforations should be of sufficiently large area to allow water containing suspended solids to pass freely through the layer without pluggage by entrapped or bridged solids.

The fingers can comprise a very large group of shaped projections. As illustrated in FIG. 2 a preferred finger is a rod-like projection which is cylindrical and projects in a direction normal to the plane of the layer. Fingers of other shapes can be utilized for instance fingers having square, hexagonal, star or oblong cross-sectional shape or with fins, etc. Such shapes can be influenced by the mold design utilized in the core forming process. Although solid fingers can be utilized, it is often desired that the fingers be hollow both for ease of fabrication and for minimizing the mass of the core to facilitate installation.

Regardless of shape, the fingers can be characterized as having a nominal diameter which is an average transverse dimension across the cross section of a finger. When the finger has a cylindrical shape normal to the plane of the base the nominal diameter is the diameter of the circular cross section; when the finger has some other geometric shape the nominal diameter is an average transverse dimension, for instance when the finger is square shaped the average transverse dimension will be somewhat greater than a side of the square but somewhat less than the diagonal of the square. The nominal diameter dimension can be approximated by the average of the maximum and the minimum distance from the center of the shape to a surface.

In most instances it is preferred that fingers have a central axis which is normal to the plane of the perforated layer. In other cases it may be desirable for fingers to project at some other angle from the perforated layer. The core can be characterized as having fingers which have a nominal diameter such that the ratio of the length of the fingers measured from the perforated layer to the end of the finger to the nominal diameter of the finger is in the range of from about 1:1 to about 8:1.

To provide a core with a maximum amount of cross-sectional area for fluid flow with the minimum resistance provided by fingers it is desirable to provide a maximum spacing between fingers. However, fingers must not be spaced so far apart that the fabric will collapse into the space between fingers because of a lack of support. In this regard it is generally desired that the core be provided with an optimum spacing of fingers which can be characterized as an average center spacing, that is, the distance between centers of fingers intercepting the base. Average center spacing can range from about 0.3 inches (0.76 cm) to about 3 inches or more (7.6 cm). In many instances it is desired that the average center spacing range from 0.9 inches (2.3 cm) to 1.25 inches (3.2 cm).

Cores having utility in the drainage mat of this invention can have fingers with a length from about 0.125 inches (0.3 cm) to 3 inches or more (7.6 cm) in length and a nominal diameter of from about 0.1 inches (0.25 cm) to 1.0 inch (2.54 cm) or more. However, it is often desired that the fingers have a length from 0.5 inches (1.3 cm) to 1.5 inches (3.8 cm) and a nominal diameter from 0.15 inches (0.4 cm) to 0.5 inches (1.3 cm).

The depth of drainage mat will be approximated by the length of the fingers and the length can be very long, for instance up to about 400 feet (122 meters). The width of the drainage mat, that is, the larger dimension of its transverse rectangular cross section can range from 6 inches (15.2 cm) to more than 4 feet (122 cm), say even up to 12 feet (365 cm) or more. The width will depend on the size of the apparatus used to fabricate the core. Larger sizes can be fabricated by fastening two or more widths of core.

Drainage mats can be fabricated from a very large variety of polymeric materials. Among the preferred materials for the core are thermoplastic materials such as polyethylene and polypropylene. For some uses, the preferred materials comprise low density polyethylene or linear low density polyethylene.

Polymeric core useful in the drainage mat of this invention can be fabricated utilizing thermoplastic molding apparatus and processes well known to those skilled in such art. A preferred procedure for fabricating polymeric core having hollow cylindrical fingers is to utilize continuous molding apparatus as described by Doleman et. al. in U.S. Pat. No. 3,507,010, incorporated herein by reference.

Figure 7:
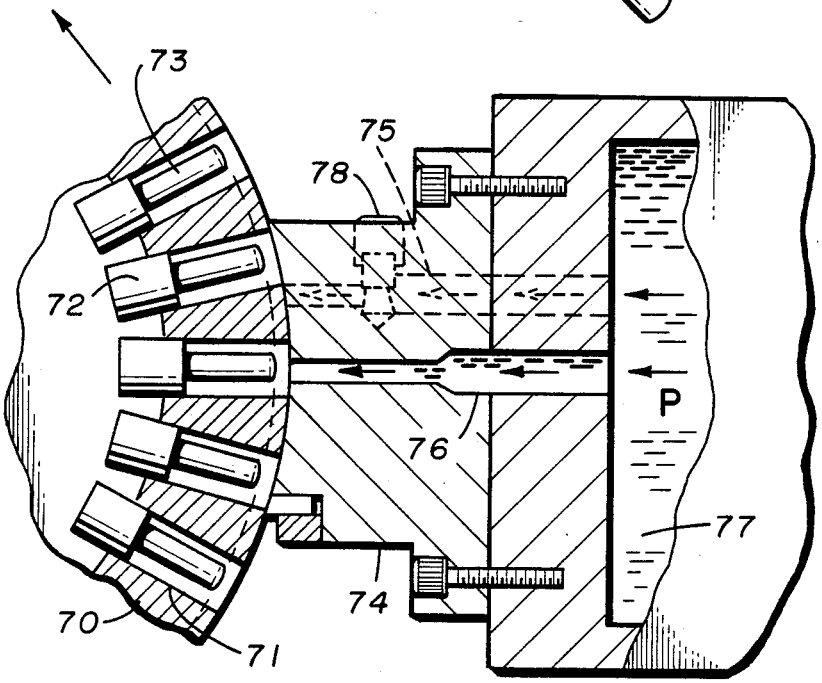
FIG. 7 schematically illustrates a partial cross-sectional view of continuous injection molding apparatus for producing polymeric core useful in the drainage mat.

FIG. 7 illustrates a cross-sectional view of such continuous molding apparatus comprising a rotating cylindrical drum 70 having a plurality of regularly spaced injection cavities 71. The cylindrical drum 70 rotates in context with stationary injection head 74. The spacing of the injection cavities 71 will correspond to the average center spacing of the fingers extending from one side of the core. The cross-sectional shape of the injection cavities can be varied to produce fingers of a desired cross section, for instance circular, rectangular, star-shaped, etc. Such fingers can also be tapered, depending on the cavity design. Hollow fingers can also be produced by providing an annular injection cavity, as illustrated in FIG. 7, where each injection cavity 71 is fitted with an insertion pin 72, having a reduced diameter extension 73. The length of the reduced diameter extension can be varied depending on the desired depth of the hollow bore within the finger.

Stationary injection head 74 has two rows of extension nozzles—high pressure nozzles 76 and low pressure nozzles 75. The high pressure nozzles 76 provide molten thermoplastic material P from a pressurized reservoir 77 to the injection cavities 71 as they rotate into communication with the end of the high pressure nozzle 76. A high pressure nozzle 76 is aligned with each row of injection cavities 71 aligned around the circumference of the cylindrical drum 70. The low pressure nozzles 75 are supplied with molten thermoplastic material P from the pressurized reservoir 77. Restrictors 78 in each low pressure nozzle reduce the pressure of the thermoplastic material exiting the end of each low pressure nozzle providing longitudinal stringers between rows of fingers.

Core geometry can be varied as desired by providing such continuous injection molding apparatus with appropriate dimensions.

The enveloping water permeable fabric can comprise a wide variety of materials. Among the preferred fabrics are those comprising polymeric materials such as polyethylene, polypropylene, polyamides, polyesters and polyacrylics. In most instances it is preferred that the fabric comprise a hydrophobic material such as polypropylene or polyester. Such fabric should be sufficiently water permeable that it exhibits a water permittivity in the range of from about 0.2 $\text{seconds}^{-1}$ to 2.0 $\text{seconds}^{-1}$. More preferred fabrics are those having a permittivity in the range of from about 0.5 $\text{seconds}^{-1}$ to about 1.0 $\text{seconds}^{-1}$. The fabric can either be of a woven or non-woven manufacture; however non-woven fabrics are often generally preferred.

Such permittivity indicates that the fabric allows adequate water flow through the fabric to the conduit part of the drainage mat. Such water flow is not so great as to allow so much suspended material to pass through the fabric that would result either in loss of subgrade support or clogging of the drainage mat.

The fabric should also exhibit substantial resistance to blinding and pluggage, for instance as may be caused by bridging or arching of soil particles next to the fabric. Since the fabric in many installations, for instance in highway edge drains, is subjected to both static and dynamic hydraulic gradient due to repeated traffic loading, dynamic permeability is an essential characteristic of the drainage mat of this invention. In general, the fabric should exhibit a dynamic permeability after $10^6$ loadings, as described in the procedure of Example III below, of at least $10^{-4}$ centimeters per second. A more preferred fabric will exhibit a dynamic permeability after $10^6$ loadings of at least $10^{-3}$ centimeters per second, for instance in the range of $10^{-2}$ to $10^{-3}$ centimeters per second. In some instances, a fabric which exhibits a dynamic permeability of as low as $10^{-5}$ centimeters per second may be acceptable.

Dynamic permeability readings may vary over the course of repeated loadings, for instance over $10^{-6}$ loadings. It is generally desired that variations in dynamic permeability be within an acceptable range based on the highest reading of dynamic permeability. For instance, the ratio of the highest reading of dynamic permeability to the lowest reading of dynamic permeability over $10^6$ loadings (a million loading dynamic permeability ratio) should not exceed 100. It is more preferred that the million loading dynamic permeability ratio be about 50 or less.

It is often desirable that the water permeable fabric envelop the entire core. When the layer is not perforated the fabric need only overlap the edges of the layer. However, when the layer is perforated the fabric should entirely envelop the core. The fabric may be provided as a sock to slip over the core. Alternatively the fabric may be wrapped around the core such that there is an overlapping longitudinal seam to form the enveloping fabric.

The fabric should of course be secured to the core particularly to the ends of the fingers to avoid collapse of the fabric into the conduit space of the core. A variety of methods of securing the fabric to the core may be employed. For instance, the fabric can be secured to the core by use of an adhesive, such as a hot melt adhesive. The fabric can also be secured to the core by the use of mechanical fasteners or by sonic welding. Alternatively, the fabric can be secured to the ends of the fingers by causing the material of the ends of the fingers to flow into the fabric.

The drainage mat of this invention is useful in any number of applications where it is desirable to remove water from an area. For instance the mat can be used in aquariums as a support for gravel. The permeability of the fabric could vary depending on whether filtering would be desired.

The drainage mat can also be advantageously utilized as a support for both natural and artificial turf. It is sometimes desirable to grow turf over a paved surface, for instance a patio or rooftop. The drainage mat of this invention can be laid in a horizontal orientation, preferably within a confined area, then covered with a layer of soil, such as loam, to support natural turf.

In many instances it is desirable to install artificial turf, such as synthetic grass-like playing surfaces, on a level surface. This has some disadvantages in outdoor installation which are subject to rainfall. Rainfall often accumulates on level installations of artificial turf to the detriment of sport activities. The drainage mat of this invention can be advantageously installed below the artificial turf, which is most often water permeable, to collect and drain away rain water. Even when installed on a level paved surface, the depth of the drainage mat will provide sufficient head to allow adequate water flow over several hundred feet to drain connections. The drainage mat of this invention has sufficient strength to support playing activity including vehicle traffic on the supported artificial turf.

Figure 9:
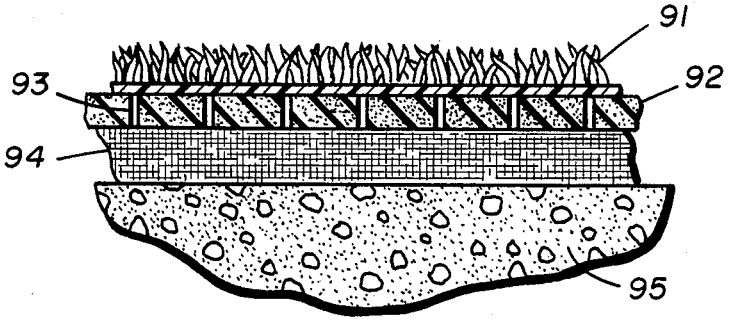
FIG. 9 is a schematic illustration of an artificial turf assembly utilizing the drainage mat of this invention.

Reference is now made to FIG. 9 which illustrates a cross-sectional view of an artificial turf playing surface supported by a drainage mat in accordance with this invention. Artificial turf 91 is installed over a resilient mat 92 having a plurality of perforations 93. The resilient mat 92 is installed over a drainage mat 94, according to this invention. The drainage mat can be installed with the layer against a supporting smooth surface 95; alternatively, if the layer is perforated, the drainage mat can be installed with the layer against the resilient mat 92. In some instances the drainage mat can be utilized without an enveloping water permeable fabric, for instance when the drainage mat is installed over concrete pavement or the like. However, when the drainage mat is installed over soil it is desirable to utilize an enveloping fabric to prevent water saturated soil from entering into the mat.

Figure 4:
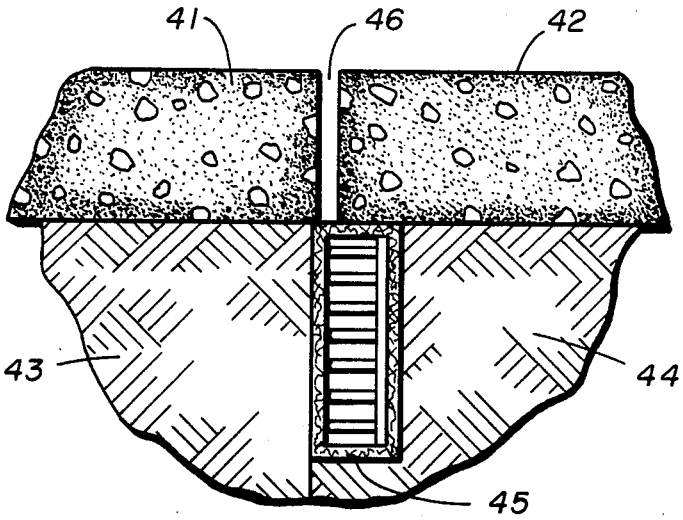
FIG. 4 schematically illustrates a cross-sectional view of a highway system with a drainage mat according to this invention installed proximate to a shoulder joint.

It is particularly useful in subsurface applications where water removal is desired. A large surface area available for drainage is provided by the rectangular transverse cross-section of the drainage mat. The drainage mat of this invention is advantageously useful with traffic-carrying surfaces for bearing traffic by motor vehicles, aircraft, rail conveyed vehicles and even pedestrains. Such use of this drainage mat is particularly advantageous in those installations where the drainage mat is installed such that the larger of its transverse cross-sectional dimensions is normal to an area to be drained. For instance the mat is useful in a vertical orientation as a traffic carrying surface edge drain, such as a highway edge drain or as a joint drain for instance where two pavement segments abut. In the vertical orientation the drainage mat is also useful in intercepting ground water flowing toward structures such as highway support beds, railroad support beds, retaining walls, building foundations and subterranean walls and the like. Such an advantageous installation is in a highway system where the drainage mat is installed parallel to a road for instance in a vertical orientation under a highway shoulder joint. In this regard FIG. 4 illustrates a highway system comprising concrete pavement 41 with an adjoining shoulder 42 which may be paved. The concrete pavement 41 overlies a support bed 43. The shoulder overlies support 44. In such an installation water infiltrating in a vertical direction through the highway shoulder joint 46 can be intercepted by the narrow transverse cross-sectional area at the top of the drainage mat 45, water present under the highway can be intercepted by the large transverse cross-sectional area which is normal to the highway support bed, and the opposing large transverse cross-sectional area can intercept ground water approaching the highway from the outside. All such intercepted water can be carried away as soon as it is collected by the drainage mat.

In other installations where it is desired to maintain a moisture level in a highway support bed, a drainage mat with an impervious layer can be installed with the impervious layer in contact with the vertical edge of the support bed to prevent the flow of ground water either into or out of the support bed. The drainage mat can intercept and carry away ground water which could otherwise enter the support bed.

Figure 10:
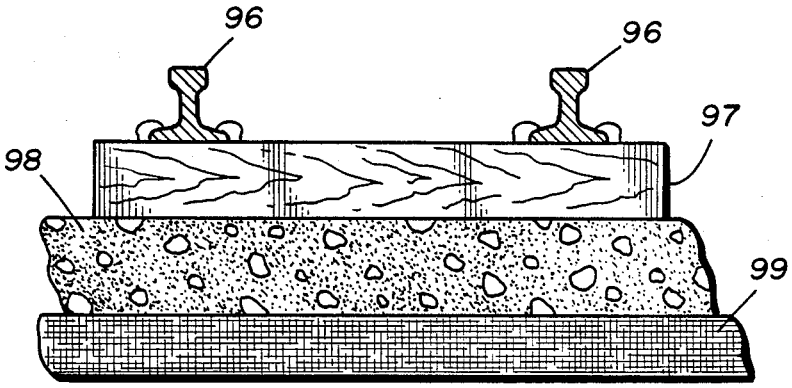
FIG. 10 is a schematic illlustration of a railroad system utilizing the drainage mat of this invention.

The drainage mat is also advantageously useful in railroad systems when installed in a horizontal orientation for instance below or within ballast. FIG. 10 schematically illustrates such an installation where a pair of rails 96 lie on cross-ties 97 which are supported by ballast 98. Drainage mat 99 according to this invention can lie below or within the ballast to stabilize the railroad system by intercepting and carrying away rain water which would allow ballast and soil to intermix undermining the support.

The drainage mat of this invention is readily installed with simple connectors and transition pieces. For instance, rectangular molded couplings fitting over the terminals of the drainage mat can readily splice two lengths of drainage mat. Transition pieces adapted to intercept the bottom edge of the drainage mat can be utilized to connect the drainage mat to standard circular conduit or pipe for conveying collected water away from the drainage mat to a sewer or drain system.

This invention is further illustrated by, but not limited to, the following examples.

EXAMPLE I

An apparatus for producing continuous lengths of three-dimensional molded products composed of a matrix having projections extending from one surface as described in U.S. Pat. No. 3,507,010, was designed to produce an artificial grass-like material. The apparatus comprises a cylindrical drum provided with a multitude of equally spaced rows of cavities, for instance on one-half inch centers. Fluted insertion pins were press-fitted into the cavities to selectively limit the penetration of injected polymer melt into the drum and thus control the height of the projections formed from the polymer. In one-fourth of the cavities the fluted insertion pins were replaced with insertion pins having a reduced diameter extension forming an annular mold space within the injection cavity. The annular mold space had an outer diameter of about ¼ inch (0.64 cm), an inner diameter of about 3/16 inch (0.48 cm) and a length of about 1 inch (2.54 cm). The remaining three-fourths of the cavities were plugged with fill pins. The pin modifications resulted in a cylindrical drum having annular injection cavities on 1 inch centers.

Linear low density polyethylene pellets were melted and fed under hydraulic pressure from a screw extruder into the distributing nozzle of the apparatus having two rows of holes which directed polymer into the cavities and grooves of the cylindrical drum. The first row of holes in contact with the rotating cylindrical drum supplied polymer to the annular mold cavities as well as the blinded cavities. The second row of holes supplied polymer to stringer grooves in the drum. Stationary fingers lying in grooves of the cylindrical drum isolated each cavity while molding took place, thus creating a zone of high pressure which allowed full depth penetration into the annular mold cavities as well as a short pillar piece in the blinded cavities. Polymer was deposited in the stringer grooves at a pressure slightly above atmospheric to control the amount of polymer fed to each groove. By adjusting the restricters it was possible to obtain a balance of molding pressures to completely fill the annular mold cavities and produce stringers flush with the surface of the cylindrical drum.

Figure 8:
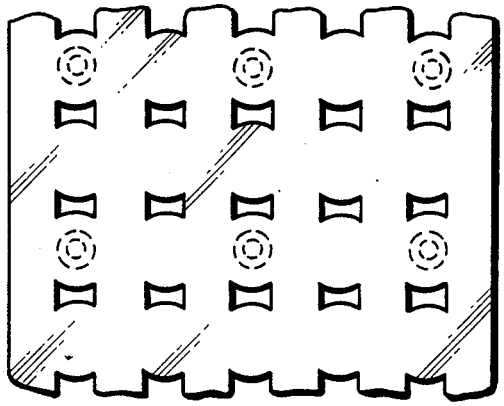
FIG. 8 illustrates a view of the surface of a useful core material opposite the side from which fingers extend.

The shape of the molded product is illustrated schematically in FIG. 2 which shows a perforated layer having a plurality of hollow cylinders extending from one surface of the layer. The cylinders had a length of 1 inch (2.54 cm), an outer diameter of about ¼ inch (0.64 cm), and an inner diameter of about 3/16 inch (0.48 cm). The cylinders were spaced at about 1 inch (2.54 cm) centers with two rows of stringers extending between rows of cylinders in the longitudinal direction. Circular plugs provided connectors between stringers on ½ inch (1.27 cm) centers as illustrated in FIG. 2. This provided a continuous layer having butterfly shaped perforations as illustrated in FIG. 8 which is a bottom view of the molded core. The molded core was provided in a width of about 6 inches (15.24 cm) with a continuous length. The core can be cut into any desired length, for instance as short as 5 feet (1.5 meters) or less or as long as 400 feet (122 meters) or more.

EXAMPLE II

Three varieties of engineering fabric were obtained. These three fabrics and their equivalent opening size (the equivalent U.S. Sieve No, as determined by Test Method CW-02215) are identified in Table 1. The three fabrics were subjected to permittivity analysis. The results of the permittivity analysis based on ten random specimens for each fabric and ten test runs on each specimen are shown in Table 2.

TABLE 1

| Fabric No. | Description | Equivalent Opening Size |
|---|---|---|
| 1. | Non-woven spunbonded polypropylene fabric, obtained from E. I. duPont de Nemours & Co. as TYPAR ® spunbonded polypropylene, Style 3601 | 140–170 |
| 2. | Woven polypropylene fabric, obtained from Advanced Construction Specialties Company designated as Type II | 35 |
| 3. | Non-woven polypropylene fabric, obtained from Amoco Fabrics Company, as PROPEX 4545 Soil Filtration Fabric, calendered | 75 (minimum) |

TABLE 2

| Fabric No. | Permittivity |
|---|---|
| 1. | 0.094 seconds$^{-1}$ |
| 2. | 1.80 seconds$^{-1}$ |
| 3. | 0.75 seconds$^{-1}$ |

EXAMPLE III

This example illustrates the test procedure for determining "dynamic permeability" of a fabric. The three varieties of engineering fabric identified in Example II were subjected to "dynamic permeability" analysis using the triaxial cell apparatus schematically illustrated in FIG. 11. The triaxial cell apparatus comprises a metal base plate 101, having a central raised boss 104 of 8 inches (20 cm) in diameter and an annular groove to accept cylinder 102. The metal base plate has a fluid port from the center of the raised boss 104 to the periphery. A flexible outer confining membrane 103 of 1/32 inch (0.8 mm) thick neoprene rubber is secured to the periphery of the central raised boss 104. Silicone grease is applied to the interface of the outer confining membrane and the central raised boss to provide a water tight seal. A porous carborundum stone 105, 8 inches (20 cm) in diameter, is placed on the central raised boss 104. Four perforated rigid plastic discs 106, 8 inches (20 cm) in diameter, are placed on carborundum stone 105. A piezometric pressure tap tubing 107 is installed in a hole in the outer confining membrane 103, just below the top of the plastic discs 106. A single layer of glass spheres 108, 0.625 inch (1.5 cm) in diameter, is placed on the top plastic disc.

A flexible inner membrane 109, having 8 inches (20 cm) diameter engineering fabric disc 110 secured to the bottom edge of flexible inner membrane 109, is inserted within the flexible outer membrane 103, such that the engineering fabric disc 110 rests on the layer of glass spheres 108. A coating of silicone grease at the interface of flexible inner membrane 9 and flexible outer membrane 103 provides a water tight seal between the two membranes.

Water is allowed to flow into the confining membrane 103 from the port in the base plate to a level above the fabric disc to remove any trapped air. The water is then drained to the level of the fabric disc 110.

Figure 13:
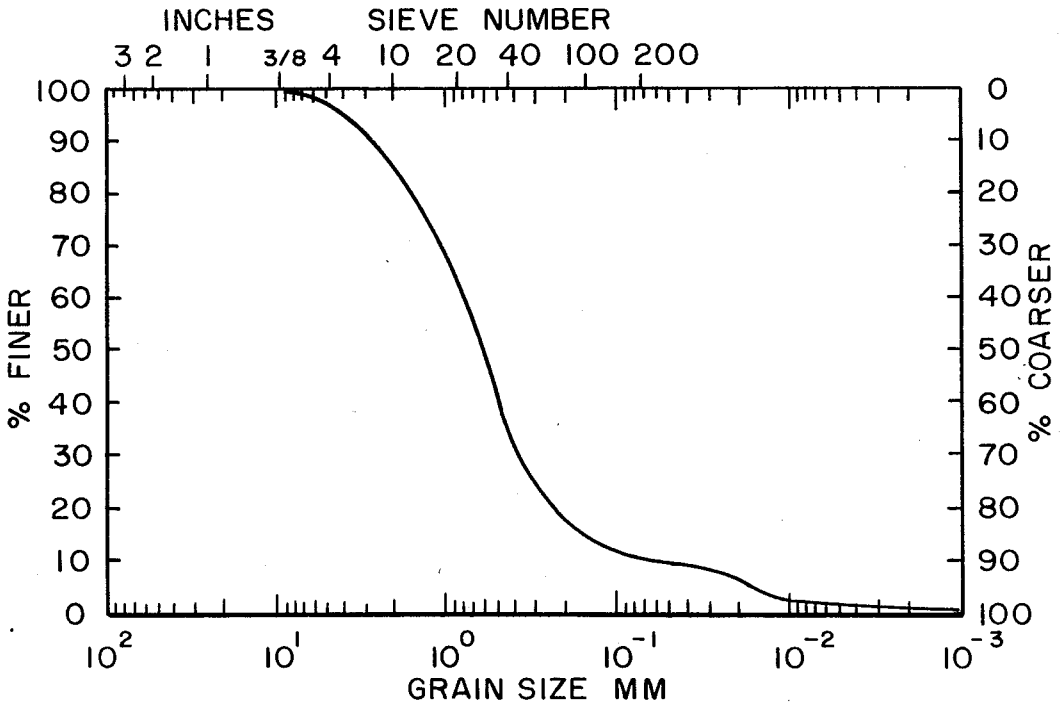
FIG. 13 is a plot of particle size analysis of a soil mixture used in determining dynamic permeability.

A dry soil mixture of 90 percent by weight Class X concrete sand (no minus number 200 sieve material) and 10 percent by weight Roxana silt is prepared. The dry soil has a gradation analysis as shown in FIG. 13. 30 pounds (13.6 kg) of dry soil is thoroughly mixed with 2 liters of water to produce a mixture at close to 100 percent water saturation. The mixture M is loaded into the flexible inner membrane 109 to a height of about 9.4 inches (24 cm) above the fabric disc 110. As the mixture M is loaded into the membrane, excess water is allowed to drain from mixture M by maintaining the open end of tubing 107 at a level about 0.4 inch (1 cm) above the fabric disc 110.

After all excess water has drained from the mixture M, a porous carborundum stone 111, 20 cm (8 inches) in diameter, is placed on the mixture M. A metal cap 112, 8 inches (20 cm) in diameter, is placed over the stone 111. Silicone grease is applied to the interface between the cap 112 and the flexible inner membrane 109. Bands (not shown) are used to secure the membranes to the cap 112. The cap 112 has two ports and a raised center boss. A transparent cylinder 102 is placed over the assembly with the bottom edge of the cylinder 102 fitting into the annular groove of the base 101. A metal cell top 113 is placed over the cylinder 102 with the top edge of the cylinder fitting into an annular groove in the cell top 113. The cell top 113 and the base plate 101 are held against the cylinder 102 by bolts (not shown).

The cell top 113 has four ports—one port is connected to tubing 114 which provides cell pressurizing water; another port is connected to tubing 115 which runs through the cell top 113 to a port on the cap 112 which can be used to provide flush water to the confined mixture M; another port is connected to tubing 116 which runs through the cell top 113 to a port on the cap 112 which provides water flow for analysis; the fourth port is connected to tubing 107 which is used to monitor pressure below the fabric disc 110. The cell top 113 has a bore through the raised boss 117. The bore allows loading rod 118 to pass through the cell top 113 to the top of metal cap 112. The bottom surface of the loading rod 118 and the top surface of the metal cap 112 have spherical indentations to receive metal sphere 119 which allows a point load to be transmitted. O-rings (not shown) provide a seal between the loading rod 118 and the bore through the cell top 113.

The triaxial cell apparatus is prepared for operation by filling the annular space between the cylinder 102 and the membranes with water to the level of the cap 112. Tubes 115 and 116 are connected from ports on the cap 112 to ports on the cell top 113. Water is allowed to enter the membrane containing mixture M from the bottom up to saturate mixture M. Valve 120 on tubing 115 can be operated to vent air. Water is allowed to fill tubing 116 connected to a pair of pressurizable reservoirs of deaerated water. The pressure within the membranes (the "internal pressure") can be adjusted through tubing 116 connected to the pressurizable reservoir which is loaded with air pressure. The pressure in space surrounding the membranes (the "confining pressure") can be adjusted through tubing 114.

Figure 11:
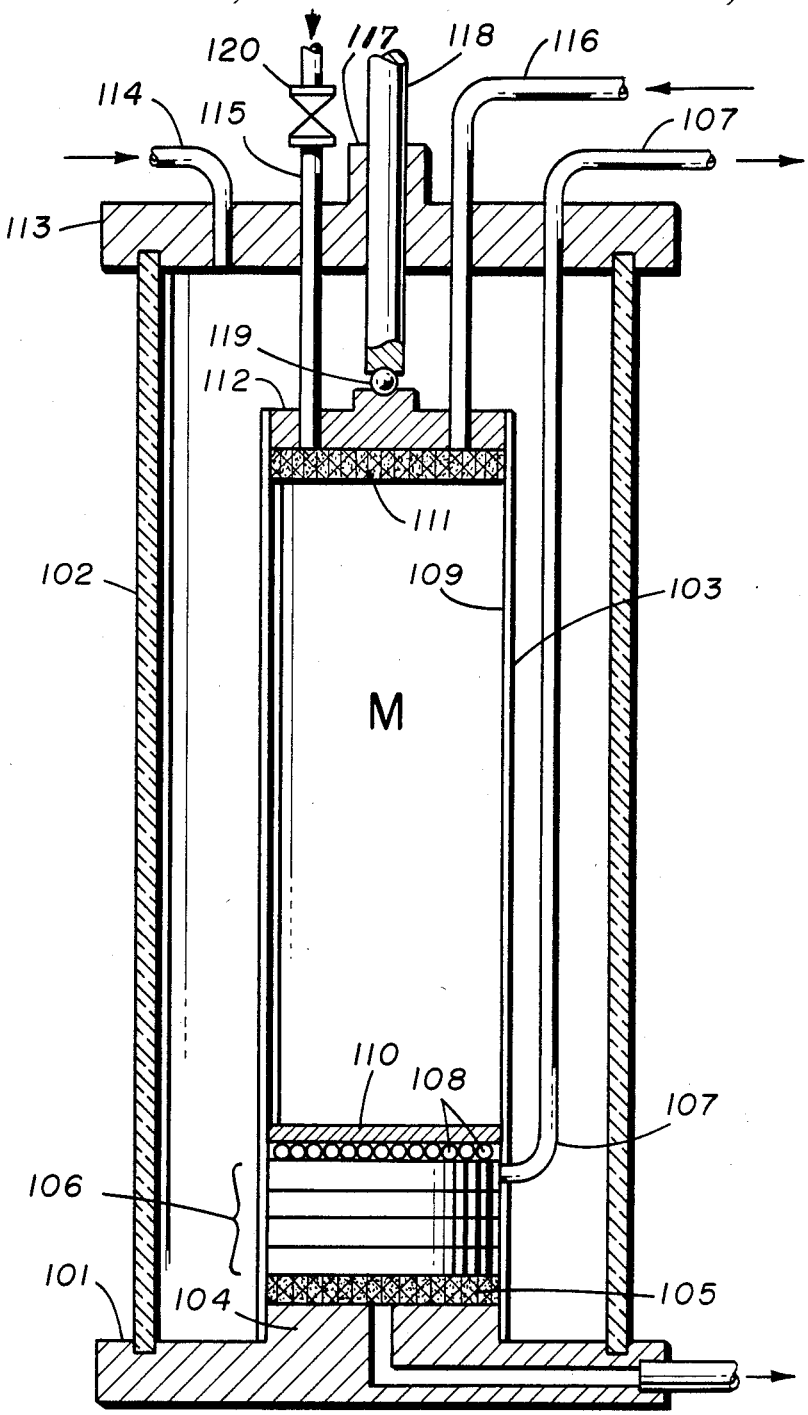
FIG. 11 is a sectional view of a triaxial cell apparatus useful in determining dynamic permeability.
Figure 12:
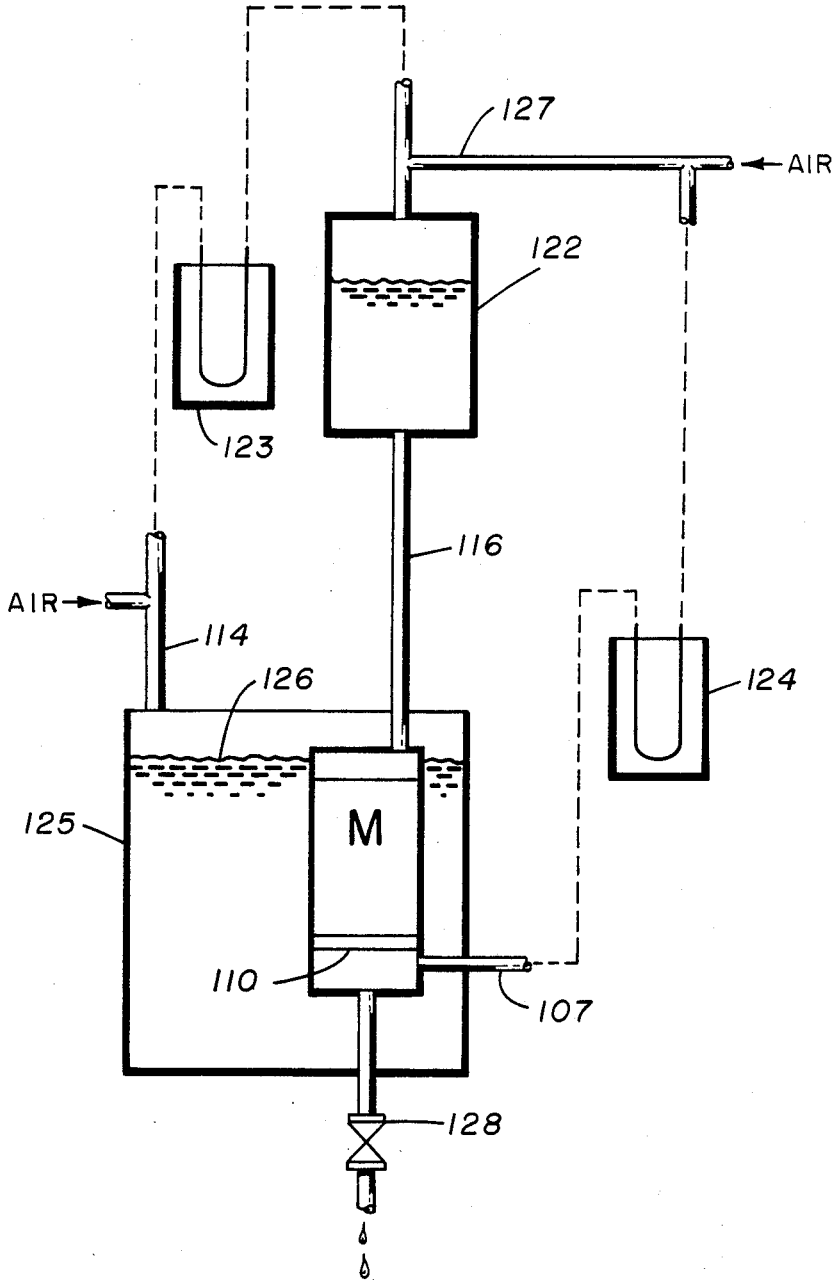
FIG. 12 is a schematic illustration of triaxial cell apparatus and ancillary equipment as used in determining dynamic permeability.

Refer now to FIG. 12 which is a simplified schematic illustration of the apparatus illustrated in FIG. 11 together with one of the pressurizable deaerated water reservoirs 122, mercury manometer 123 and water manometer 124. The pressurizable reservoir 122 is located above the triaxial cell 125, for instance a convenient distance between the average height of water in the reservoir and the level of water 126 in the triaxial cell 125 is 100 cm.

It is desirable to operate with the air pressure on the reservoir 122 at about 220 kN/m$^2$ (32 psi) while maintaining a "net confining pressure" of 12.1 kN/m$^2$ (1.75 psi). Net confining pressure, P, can be calculated from the following equation:

$$P=1.33(H-HW/13.6),$$

where

P is the net confining pressure, expressed in terms of kN/m$^2$;

H is the pressure difference, measured by mercury manometer 23, of the excess air pressure at tubing 14 over air pressure at tubing 27; and HW is the average distance between the level of water in reservoir 22 and the level of water 26 in the triaxial cell 25.

For instance, when HW is about 100 cm, it is desirable to slowly increase the confining pressure measured at tubing 114 to at least 15 cm Hg (6 inches Hg) greater than the pressure at tubing 127. Then both pressures are slowly raised until the air pressure on the reservoir 122 is about 220 kN/m$^2$ (32 psig). The confining pressure should be adjusted such that the mercury manometer 123 indicates that the air pressure at tubing 114 is 16.5 cm Hg (6.5 inches Hg) greater than the air pressure at tubing 127. This should provide a net confining pressure of about 12.1 kN/m$^2$ (1.75 psi).

Flow is initiated by opening bleeder valve 128. The rate of flow is adjusted to generate a pressure drop measured at water manometer 124 in the range of 24 to 26 cm water (about 9.5 to 10.25 inches water). Readings of flow rate, time and water mamometer differential are recorded until permeability is stabilized, for instance usually 10 to 15 minutes. Axial loading via loading rod 118 is then started. An air actuated diaphragn air cylinder (not shown) is connected to the loading rod 118. A load pulse of 17.5 kN/m$^2$ (2.5 psi) is applied to the cap 112 and transmitted to mixture M at a frequency of once every two seconds (0.5 hertz). This loading simulates stress within the mixture M similar to subgrade stress from truck loading on a highway system.

Readings are taken after 1, 10, 100 and 500 loads and thereafter generally at six hour intervals.

Dynamic permeability of the engineering fabric is calculated from the following equation:

$$K=QL/HAT$$

where

K is dynamic permeability, expressed in terms of cm/sec;

Q is water flow volume, expressed in terms of cm$^3$, collected over time, T;

L is the height of soil mixture M, expressed in terms of cm;

H is the hydraulic gradient over the mixture as measured on water manometer 24, expressed in terms of cm;

A is the cross-sectional area of the fabric disc 10, expressed in terms of cm$^2$; and T is the time to collect a volume Q, expressed in terms of sec.

Figure 14:
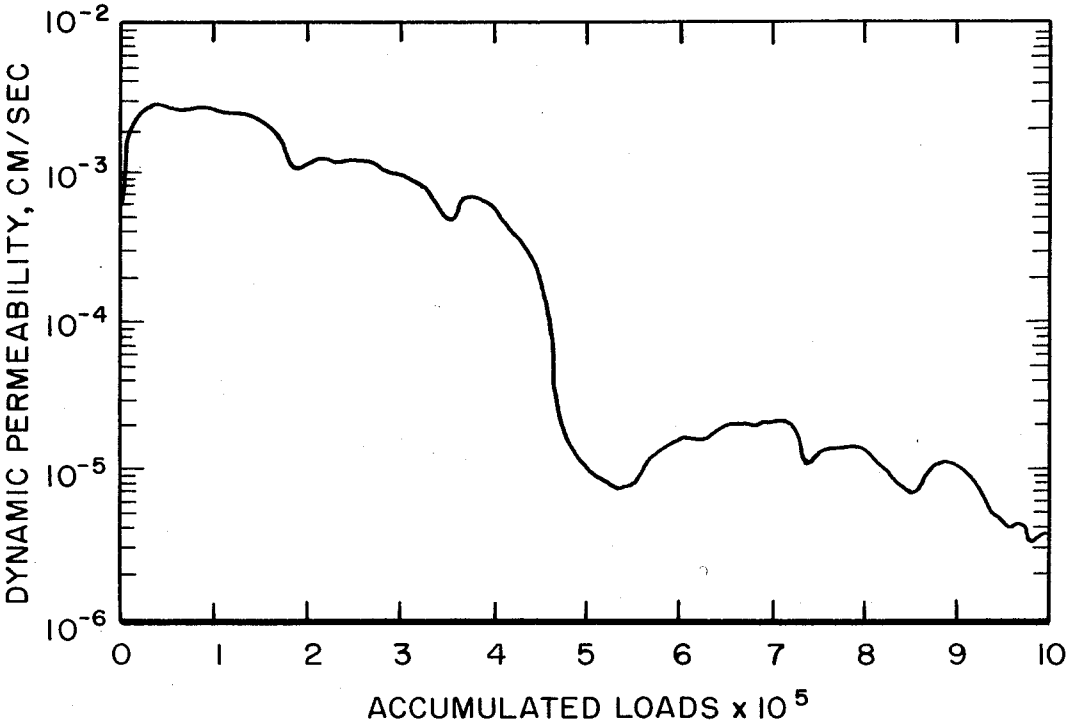
FIGS. 14, 15 and 16 are plots of dynamic permeability for accumulated loadings for various engineering fabrics.
Figure 15:
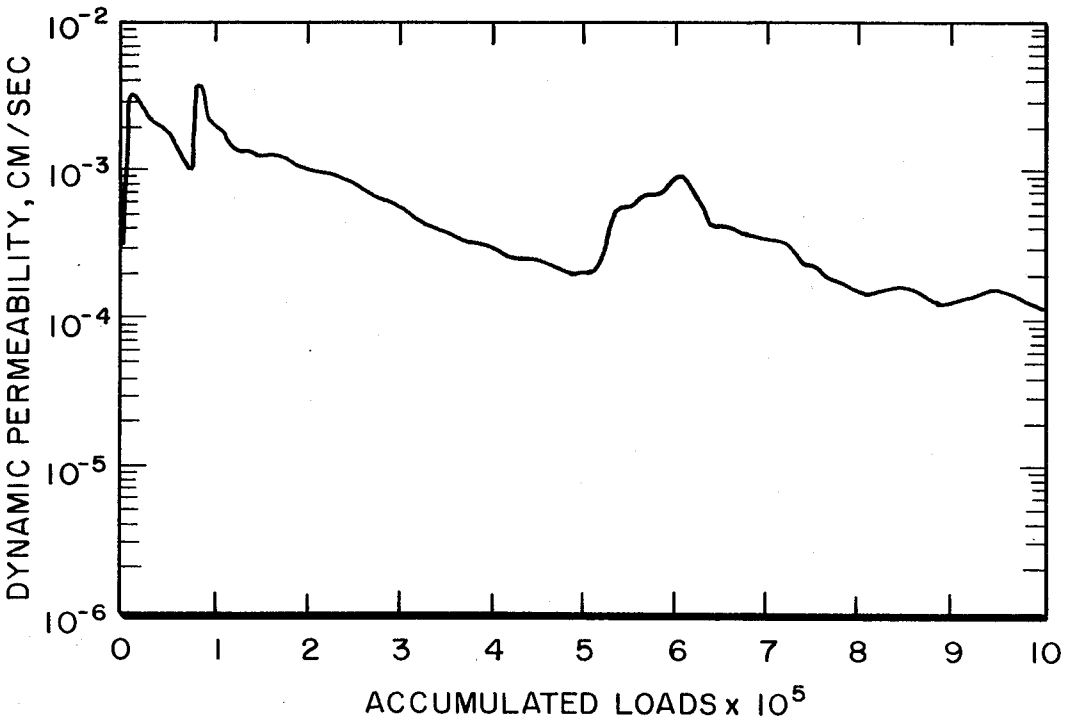
Figure 16:
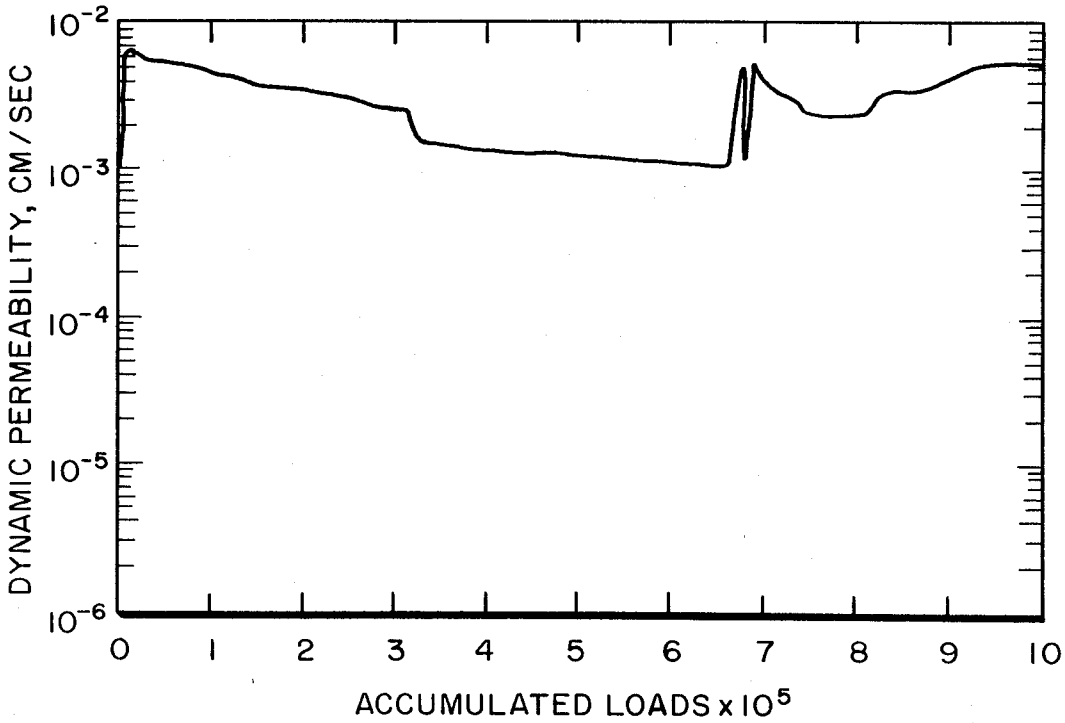

Dynamic permeability for the engineering fabrics identified in Example I is shown in FIGS. 14, 15 and 16, which are plots of dynamic permeability versus loadings.

FIG. 14 is a plot of dynamic permeability, recorded for Fabric No. 1, which decreases to less than $10^{-4}$ cm/sec after about 450,000 loadings.

FIG. 15 is a plot of dynamic permeability, recorded for Fabric No. 2, which decreases gradually but remains above $10^{-4}$ cm/sec even after one million loadings.

FIG. 16 is a plot of dynamic permeability, which remains between $10^{-3}$ and $10^{-2}$ cm/sec over the application of one million loadings.

In view of the results of dynamic permeability analysis, Fabric No. 1 would be unacceptable for use with the drainage mat of this invention, while Fabric No. 2 and Fabric No. 3 would be acceptable for use with the drainage mat of this invention. Fabric No. 3 is exemplary of a more preferred fabric.

EXAMPLE IV

A 2 foot×4 foot (0.61 m×1.22 m) section of core material was fabricated from molded core material as produced in Example I. A drainage mat was produced by enveloping the section of core with a water permeable fabric which was secured to the back side of the perforated sheet and to the ends of the hollow cylinders with a hot melt adhesive. The water permeable fabric was a non-woven polypropylene fabric available from Amoco Fabrics Company under the trade name PROPAX 4545 Soil Filtration Fabric. Such fabric is specified as having the following properties: tensile strength of 90 lbs. as determined by American Society for Testing and Materials (ASTM), standard test method D-1682; elongation of 60 percent, as determined by ASTM-D-1682; burst strength of 230 psi as determined by Mullen Burst Test; accelerated weathering strength retained of 70 percent, as determined by Federal Test Method CCC-T-191, method 5804 (500 hours exposure); equivalent opening size of 70 (minimum equivalent U.S. Sieve No.), as determined as CW-02215; and a permeability coefficient of 0.2 cm/sec, as determined by a falling head method from 75 mm to 25 mm.

The fabric was also determined to have a permittivity per fabric layer of 0.75 cm/sec, as determined by the test method defined in Appendix A of Transportation Research Report 80-2 available from United States Department of Transportation, Federal Highway Administration.

The fabric was also determined to have a dynamic permeability after $10^6$ loadings of at least $10^{-4}$ centimeters per second. In fact the dynamic permeability was in excess of $10^{-3}$ centimeters per second.

EXAMPLE V

The drainage mat prepared in Example IV was installed in a lysimeter for outflow studies to evaluate its drainage performance. The lysimeter consisted of a large water-proof box 96 inches (244 cm) long, 48 inches (122 cm) deep and 48 inches (122 cm) wide. The top of the box was open. The box was filled to a depth of 3 feet (91.4 cm) with a compacted subgrade soil characterized by American Association of State Highway Transportation Officials (AASHTO) classification system A-7-6. Eight inch (20.3 cm) wide slots were then excavated in the subgrade material to a depth of 2 feet (61 cm). An outflow pipe was installed through the side wall of the water-proof box to intercept the excavated slot at the base. The drainage mat was installed in a vertical orientation with the surface of the mat proximate the perforated base lying against the side wall of the slot. The lower 12 inches (30.5 cm) of the slot was refilled with compacted subgrade soil (AASHTO A-7-6). The remainder of the slot as well as the 6 inches (15.2 cm) above the 3 foot (91.4 cm) depth of compacted subgrade soil (AASHTO A-7-6) was filled with a coarse sand material (AASHTO A-1-B).

To conduct the outflow studies a head of water was maintained in the lysimeter at a level 5 inches above the surface of the coarse sand material. Water flowing from the outflow pipe was measured periodically to determine an outflow rate. Instantaneous outflow rates, measured in units of gallons per day, were recorded after various elapsed time, measured in units of days. These outflow rates are tabulated in Table 3.

TABLE 3

| Elapsed Time | Instantaneous Outflow Rate (gal/day) | ($m^3$/day) |
|---|---|---|
| 1 day | 297 | 1.12 |
| 2 days | 232 | 0.88 |
| 10 days | 449 | 1.70 |
| 20 days | 350 | 1.32 |
| 50 days | 281 | 1.06 |
| 100 days | 272 | 1.03 |
| 155 days | 228 | 0.86 |

EXAMPLE VI

This example illustrates the load deflection resistance of the drainage mat produced in Example IV. A section of drainage mat fabricated in accordance with Example IV was laid in a horizontal orientation with the surface proximate the perforated layer in contact with a base. An open bottom/open top rectangular box having inside dimensions of 4 inches (10.2 cm) and 5½ inches (14.0 cm) was placed on the drainage mat surface proximate the ends of the cylinders. The box was partially filled with AASHTO A-7-6 soil which was covered by a 4 inch by 5½ inch (10.2 cm×14.0 cm) steel compression plate. Guide casings were installed through holes in the compression plate through the soil to contact the surface of the drainage mat. One guide casing was installed on the fabric above a cylinder; another guide casing was installed on the fabric between cylinders. Extension pins from dial gauges were passed through the guide casings to the fabric surface. As the load on the compression plate was increased in increments of 100 lbf (0.445N). the deflection of the surface of the drainage mat was measured by the dial gauges. The results of this load deflection test are tabulated in Table 4.

TABLE 4

LOAD DEFLECTION TEST

| Applied Load (kN) | Unit Pressure (kPa) | Fabric Deflection[1] (mm) | Fabric Deflection[2] (mm) |
|---|---|---|---|
| .4 | 31 | 0.15 | 0.0 |
| .9 | 63 | 0.36 | 0.0 |
| 1.3 | 94 | 0.41 | 0.0 |
| 1.8 | 125 | 0.43 | 0.0 |
| 2.2 | 157 | 0.53 | 0.0 |
| 2.7 | 188 | 0.53 | 0.0 |
| 3.1 | 219 | 0.58 | 0.0 |
| 3.6 | 251 | 0.58 | 0.0 |
| 4.0 | 282 | 0.64 | 0.0 |
| 4.5 | 313 | 0.74 | 0.0 |
| 4.9 | 345 | 0.74 | 0.0 |
| 5.3 | 376 | 0.76 | 0.0 |
| 5.8 | 407 | 0.76 | 0.0 |
| 6.2 | 439 | 1.07 | 0.0 |
| 6.7 | 470 | 1.24 | 1.75 |
| 7.1 | 501 | 2.01 | 1.88 |
| 7.6 | 533 | 2.97 | 2.39 |
| 8.0 | 564 | 3.12 | 2.39 |
| 8.5 | 595 | 3.28 | 2.57 |

TABLE 4-continued

| LOAD DEFLECTION TEST | | | |
|---|---|---|---|
| Applied Load (kN) | Unit Pressure (kPa) | Fabric Deflection[1] (mm) | Fabric Deflection[2] (mm) |
| 8.9 | 620 | 4.42 | 4.39 |

[1]measured between cylinders
[2]measured over cylinder

While the invention has been described herein with regard to certain specific embodiments, it is not so limited. It is to be understood that variations and modifications thereof may be made by those skilled in the art without departing from the spirit and scope of the invention.

What is claimed is:

1. An elongated bendable drainage mat having a rectangular transverse cross-section, said drainage mat comprising:

a polymeric core having a plurality of substantially rigid fingers extending from one side of a layer and an enveloping water permeable fabric, wherein said fabric has a permittivity from 0.2 seconds$^{-1}$ to 2.0 seconds$^{-1}$ and exhibits a dynamic permeability after $10^6$ loadings of at least $10^{-4}$ centimeters per second, such that said mat is resistant to soil pluggage from pulsing water flow.

2. The mat of claim 1 wherein the fabric is secured to a sufficient number of ends of said fingers such that the fabric does not unduly collapse.

3. The mat of claim 2 which is readily bendable only such that the surface of the drainage mat proximate the ends of the fingers can be concavely rolled over any bending axis, which is parallel to the plane of the layer and rotationally disposed at any angle from 0° to 180° from the axis of elongation of the mat.

4. The mat of claim 3 wherein the surface of the drainage mat proximate the ends of the fingers can be concavely rolled up to 180° over a bending axis having a diameter of less than about 1.0 inch.

5. The mat of claim 4 wherein the fingers have a nominal diameter such that the ratio of length of the fingers to nominal diameter is in the range of 1:1 to 8:1.

6. The mat of claim 5 wherein the fingers have an average center spacing from one another such that the ratio of average center spacing to nominal diameter is 2:1 to 20:1.

7. The mat of claim 6 wherein the fingers have a length from 1.3 to 3.8 centimeters, a nominal diameter from 0.4 to 1.1 centimeters and an average center spacing from 2.3 to 3.2 centimeters, wherein the rectangular transverse cross section has a long dimension from 15 centimeters to 3.6 meters.

8. A highway system comprising a pavement section and a shoulder, positioned adjacent to the pavement section to form a joint therebetween, and a vertically-oriented, elongated, bendable drainage mat having a rectangular cross section; wherein said mat comprises a polymeric core having a plurality of substantially rigid fingers extending from one side of a layer and an enveloping water permeable fabric; wherein said fabric has a permitivity from 0.2 seconds$^{-1}$ to 2.0 seconds$^{-1}$ and exhibits a dynamic permeability after $10^6$ loadings of a least $10^{-4}$ centimeters per second; wherein said mat has an upper edge positioned in substantial alignment with the joint, said edge being positioned sufficiently close to said joint to intercept substantially all of any water passing through said joint to thereby prevent said water from spreading under said pavement section and shoulder.

9. The highway system of claim 8 comprising a drainage mat wherein said fabric is secured to a sufficient number of ends of said fingers such that the fabric does not unduly collapse.

10. The highway system of claim 9 comprising a drainage mat which is readily bendable only such that the surface of the drainage mat proximate the ends of the fingers can be concavely rolled over any bending axis, which is parallel to the plane of the layer and rotationally disposed at any angle from 0° to 180° from the axis of elongation of the mat and has a diameter of less than about 1.0 inch.

11. The highway system of claim 10 comprising a drainage mat wherein the fingers are cylindrical and have a length from 1.3 to 3.8 centimeters a nominal diameter from 0.4 to 1.1 centimeters and an average center spacing from 0.8 to 8.0 centimeters.

12. The highway system of claim 11 comprising a drainage mat wherein the layer is perforated.

13. A traffic carrying surface system comprising at least two pavement sections separated by an elongated joint and at least one vertically-oriented elongated drainage mat having a rectangular cross-section installed below, in substantial alignment with, and proximate to said elongated joint, said elongated drainage mat comprising a polymeric core having a plurality of substantially rigid fingers extending from one side of a layer and an enveloping water permeable fabric, wherein said fabric has a permittivity from 0.2 seconds$^{-1}$ to 2.0 seconds$^{-1}$ and exhibits a dynamic permeability after $10_6$ loadings of at least $10^{-4}$ centimeters per second, such that said drainage mat is resistant to soil pluggage from pulsing water flow.

* * * * *